US011939702B2

(12) United States Patent
Gil

(10) Patent No.: US 11,939,702 B2
(45) Date of Patent: Mar. 26, 2024

(54) METHOD OF MANUFACTURING HIGHLY ELASTIC FABRIC INCLUDING LATENT CRIMPED YARN

(71) Applicant: Kyung Taek Gil, Seoul (KR)

(72) Inventor: Kyung Taek Gil, Seoul (KR)

( * ) Notice: Subject to any disclaimer, the term of this patent is extended or adjusted under 35 U.S.C. 154(b) by 499 days.

(21) Appl. No.: 17/329,527

(22) Filed: May 25, 2021

(65) Prior Publication Data

US 2021/0372009 A1 Dec. 2, 2021

(30) Foreign Application Priority Data

May 27, 2020 (KR) ..... 10-2020-0063878

(51) Int. Cl.

| | |
|---|---|
| ***D02G 3/30*** | (2006.01) |
| ***D01D 5/22*** | (2006.01) |
| ***D01D 5/32*** | (2006.01) |
| ***D01F 8/14*** | (2006.01) |
| ***D02G 3/32*** | (2006.01) |
| ***D06C 7/00*** | (2006.01) |
| ***D06P 1/16*** | (2006.01) |

(52) U.S. Cl.

CPC ..... *D01F 8/14* (2013.01); *D01D 5/22* (2013.01); *D01D 5/32* (2013.01); *D02G 3/30* (2013.01); *D02G 3/32* (2013.01); *D06C 7/00* (2013.01); *D06P 1/16* (2013.01)

(58) Field of Classification Search

CPC ... D02G 3/32; D02G 3/30; D06C 7/00; D01D 5/22

USPC ..... 28/155, 156

See application file for complete search history.

(56) References Cited

U.S. PATENT DOCUMENTS

| | | | | |
|---|---|---|---|---|
| 2,539,300 | A * | 1/1951 | Foster | D03D 15/587 428/375 |
| 5,102,724 | A * | 4/1992 | Okawahara | D04H 1/43832 26/18.5 |
| 2015/0020546 | A1* | 1/2015 | Zhang | D04B 21/18 28/155 |
| 2017/0167061 | A1* | 6/2017 | Date | D03D 15/56 |
| 2018/0245248 | A1* | 8/2018 | Buffington | D03D 9/00 |
| 2020/0318261 | A1* | 10/2020 | Yamada | D03D 15/68 |

FOREIGN PATENT DOCUMENTS

| | | | |
|---|---|---|---|
| KR | 10-2009-0021787 | A | 3/2009 |
| KR | 10-2012-0035984 | A | 4/2012 |
| KR | 10-1594290 | B1 | 2/2016 |

* cited by examiner

*Primary Examiner* — Jillian K Pierorazio
(74) *Attorney, Agent, or Firm* — The PL Law Group, PLLC

(57) ABSTRACT

A method of manufacturing an elastic fabric including a latent crimped yarn according to an embodiment includes forming a raw fabric by knitting the latent crimped yarn and a polyester yarn, reducing the raw fabric, removing oil from the raw fabric, removing wrinkles of the raw fabric, followed by drying, dyeing the raw fabric, and removing wrinkles of the raw fabric, followed by drying to form the elastic fabric. The method can manufacture a highly elastic fabric having excellent recovery and color fastness to washing.

11 Claims, 2 Drawing Sheets

METHOD OF MANUFACTURING HIGHLY ELASTIC FABRIC INCLUDING LATENT CRIMPED YARN

CROSS REFERENCE TO RELATED APPLICATION

The present application claims priority to Korean Patent Application No. 10-2020-0063878, filed May 27, 2020, the entire contents of which is incorporated herein for all purposes by this reference.

BACKGROUND

1. Field of the Invention

The present disclosure relates generally to a method of manufacturing a highly elastic fabric including a latent crimped yarn. More particularly, the present disclosure relates to a method of manufacturing a highly elastic fabric by performing a series of steps, including reduction, degreasing, tentering, dyeing, and tentering, on a raw fabric, the raw fabric being formed by knitting a latent crimped yarn of bi-component type and a polyester yarn, the latent crimped yarn being obtained by conjugate-spinning polytrimethylene terephthalate (PTT) and polyethylene terephthalate (PET) on a yarn cross-section in a side-by-side form.

2. Description of the Related Art

A garment made of a conventional fabric is problematic in that when a wearer bends or moves a portion corresponding to an arm, leg, or joint portion, a fabric portion corresponding to the portion is severely wrinkled or stretched. In recent years, preference for practical and comfortable garments has been increasing, and the boundary between everyday wear and sportswear suitable for leisure, hiking, and the like has been disappearing. Accordingly, there is an increasing demand for all products of garments to have elasticity capable of repeating the stretching and shrinking in response to movement of the human body and minimizing deformation caused thereby.

For example, in Korean Patent Application Publication No. 10-2012-0035984, there is disclosed a method of manufacturing a spandex fabric having excellent elasticity, manufactured by the following steps: 1) dyeing spandex yarns and then impregnating the same with a shape memory processing agent; 2) drying the impregnated spandex yarns, 3) collecting the dried yarns, and 4) weaving the spandex yarns as warp yarns and synthetic fiber yarns as weft yarns to manufacture a fabric.

Spandex is a highly elastic fiber with at least 85% polyurethane. The use of spandex has recently been increasing for the purpose of improving elasticity of garments.

However, spandex is problematic in that the degree to which the fabric is damaged over time is severe, and the fabric is low in color fastness to washing and lacks sufficient recovery. In addition, the use of spandex yarns is problematic in that the fabric shrinks due to heat treatment performed in the process of manufacturing the fabric, resulting in creases, and a large amount of substances harmful to the environment and the human body are generated.

Therefore, there is a demand to develop a fabric that not only has excellent properties, such as elasticity, recovery, and color fastness to washing, without requiring the use of spandex, but also has minimized defects due to shrinkage occurring in a fabric manufacturing process.

The foregoing is intended merely to aid in the understanding of the background of the present disclosure, and is not intended to mean that the present disclosure falls within the purview of the related art that is already known to those skilled in the art.

SUMMARY

Accordingly, the present disclosure has been made keeping in mind the above problems occurring in the related art, and an aspect of the present disclosure is to provide a method of manufacturing a fabric that not only has excellent properties, such as elasticity, recovery, and color fastness to washing, without requiring the use of spandex, but also has minimized defects due to shrinkage occurring in a fabric manufacturing process.

The aspect of the present disclosure is not limited to the above-described technical problem, and other technical problems can be inferred from the following description.

In order to achieve one or more of the above aspects, according to an embodiment of the present disclosure, there is provided a method of manufacturing a highly elastic fabric including a latent crimped yarn, the method including: (a) forming a raw fabric by knitting the latent crimped yarn and a polyester yarn; (b) reducing the raw fabric; (c) removing oil from the raw fabric; (d) removing wrinkles of the raw fabric, followed by drying; (e) dyeing the raw fabric; and (f) removing wrinkles of the raw fabric, followed by drying to form the highly elastic fabric, wherein the dyeing of the raw fabric may include: dyeing the raw fabric with a disperse dye; subjecting the dyed raw fabric to a primary heat treatment at 35 to 45° C.; subjecting the raw fabric subjected to the primary heat treatment to a secondary heat treatment at 75 to 85° C.; subjecting the raw fabric subjected to the secondary heat treatment to a tertiary heat treatment at 120 to 130° C.; and cooling the raw fabric subjected to the tertiary heat treatment to 50 to 70° C.

The latent crimped yarn may be a yarn obtained by conjugate-spinning polytrimethylene terephthalate (PTT) and polyethylene terephthalate (PET) on a yarn cross-section in a side-by-side form.

The latent crimped yarn may have a crimp potential of 20 to 80%.

The latent crimped yarn may have a boiling water shrinkage of 10 to 50%.

The latent crimped yarn may have a fineness of at least one selected from the group consisting of 30D/24F, 30D/36F, 50D/24F, 50D/36F, 75D/24F, 75D/32F, and 75D/36F.

The polyester yarn may have a fineness of at least one selected from the group consisting of 30D/12F, 30D/24F, 30D/36F, 30D/48F, 45D/24F, 50D/24F, 50D/36F, 50D/72F, 50D/96F, and 75D/72F.

The forming of the raw fabric may be performed by knitting the latent crimped yarn and the polyester yarn in a weight ratio of 1:0.5 to 2 to form the raw fabric.

The primary heat treatment may be performed for 5 to 15 minutes.

The secondary heat treatment may be performed for 2 to 8 minutes.

The tertiary heat treatment may be performed for 25 to 40 minutes.

The cooling of the raw fabric may be performed by cooling the raw fabric subjected to the tertiary heat treatment at a cooling rate of 1 to 3° C./min.

According to the present disclosure, it is possible to manufacture a fabric having elasticity, recovery, and color fastness to washing similar to or superior than spandex without requiring the use of spandex. In addition, it is possible to significantly reduce defects due to shrinkage occurring in the manufacturing process of the fabric, which can be advantageous in economic terms.

In addition, although the related art employing the use of melting treatment of spandex yarns is problematic in that not only a fabric shrinks to cause defects, but also substances harmful to the environment and the human body are generated, the present disclosure can prevent the above problem from occurring by excluding the use of spandex.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

Figure 1:
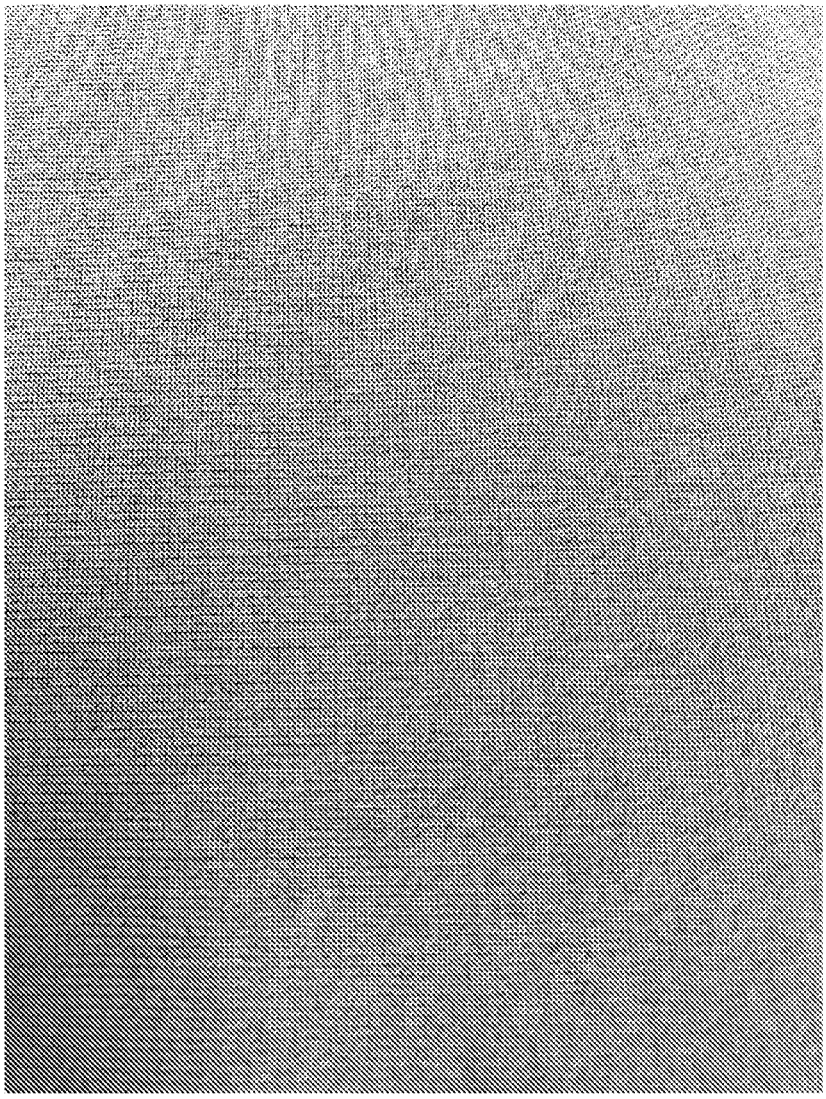
FIG. 1 is a view illustrating a fabric manufactured according to Example 1.

Hereinbelow, exemplary embodiments of the present disclosure will be described in detail with reference to the accompanying drawings such that the disclosure can be easily embodied by one of ordinary skill in the art to which this disclosure pertains. However, the present disclosure is not limited to embodiments described below, but may be implemented in various different forms. In order to clearly illustrate the disclosure, parts not related to the description are omitted.

All terms or words used herein should not be interpreted as being limited merely to common and dictionary meanings but should be interpreted as having meanings and concepts which are defined within the technical scope of the present disclosure. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

As used herein, the meaning of "A and/or B" means A or B, or A and B.

Hereinafter, a detailed description will be given of the present disclosure, but the present disclosure is not limited thereto.

The present disclosure provides a method of manufacturing a highly elastic fabric including a latent crimped yarn.

In an embodiment of the present disclosure, there is provided a method of manufacturing a highly elastic fabric, the method including: (a) a fabric forming step of forming a raw fabric by knitting a latent crimped yarn and a polyester yarn; (b) a fabric reduction step of reducing the raw fabric; (c) a fabric degreasing step of removing oil from the raw fabric; (d) a primary tentering step of removing wrinkles of the raw fabric, followed by drying; (e) a fabric dyeing step of dyeing the raw fabric; and (f) a secondary tentering step of removing wrinkles of the raw fabric, followed by drying to form the highly elastic fabric, wherein the fabric dyeing step includes: a dyeing step of dyeing the raw fabric with a disperse dye; a primary heat treatment step of subjecting the dyed raw fabric to a primary heat treatment at 35 to 45° C.; a secondary heat treatment step of subjecting the raw fabric subjected to the primary heat treatment to a secondary heat treatment at 75 to 85° C.; a tertiary heat treatment step of subjecting the raw fabric subjected to the secondary heat treatment to a tertiary heat treatment at 120 to 130° C.; and a fabric cooling step of cooling the raw fabric subjected to the tertiary heat treatment to 50 to 70° C.

According to the present embodiment, it is possible to provide a fabric having elasticity, recovery, and color fastness to washing similar to or superior to spandex without requiring the use of spandex. In addition, defects due to shrinkage occurring in the manufacturing process of the fabric may be significantly reduced, which may be advantageous in economic terms.

In particular, in the related art employing the use of melting treatment on spandex yarns, there is a problem in that not only a fabric shrinks to cause defects, but also substances harmful to the environment and the human body are generated.

However, in the present disclosure, as the use of spandex is excluded, the occurrence of the above problem may be prevented.

(a) The Fabric Forming Step of Forming the Raw Fabric by Knitting the Latent Crimped Yarn and the Polyester Yarn In the fabric forming step of the present embodiment, the raw fabric is formed by knitting the latent crimped yarn and the polyester yarn. At this time, the knitting is performed by a known knitting process.

The latent crimped yarn of the present embodiment serves to improve the elasticity and recovery of the fabric manufactured according to the present embodiment. The latent crimped yarn of the present embodiment may be a yarn subjected to a warping process under conditions of 350 to 450 rpm.

The latent crimped yarn of the present embodiment may be a Bi-component yarn including polytrimethylene terephthalate (PTT) and polyethylene terephthalate (PET). Specifically, the latent crimped yarn of the present embodiment may be a bi-component yarn obtained by conjugate-spinning PTT and PET on a yarn cross-section in a side-by-side form.

The latent crimped yarn of the present embodiment may have a crimp potential of 20 to 80%. In particular, when the crimp potential of the latent crimp yarn of the present embodiment is 20 to 80%, the fabric manufactured according to the present embodiment may realize excellent elasticity, recovery, and color fastness to washing.

The latent crimped yarn of the present embodiment may have a boiling water shrinkage (BWS) of 10 to 50%. In particular, when the boiling water shrinkage of the latent crimp yarn of the present embodiment is 10 to 50%, the fabric manufactured according to the present embodiment may realize excellent elasticity, recovery, and color fastness to washing.

The latent crimped yarn of the present embodiment may have a fineness of at least one selected from the group consisting of 30D/24F, 30D/36F, 50D/24F, 50D/36F, 75D/24F, 75D/32F, and 75D/36F. Specifically, the latent crimped yarn may have a fineness of at least one selected from the group consisting of 50D/24F and 50D/36F, but is not limited thereto. In particular, when the latent crimped yarn of the present embodiment has the above-described fineness, the fabric manufactured according to the present embodiment may have excellent elasticity, recovery, and color fastness to washing.

At this time, the meaning that the fineness of the latent crimped yarn is 50D/36F may mean that the latent crimped yarn is a 50 denier yarn with 36 filaments.

The polyester yarn of the present embodiment serves to improve the elasticity and recovery of the fabric manufactured according to the present embodiment.

The polyester yarn of the present embodiment may be a yarn made of at least one fiber selected from the group consisting of all synthetic fibers and regenerated fibers made of a polyester-based material, but is not limited thereto. Specifically, the polyester yarn of the present embodiment may be a yarn made of at least one fiber selected from the group consisting of all synthetic fibers and regenerated fibers made of a PET-based material, but is not limited thereto.

The polyester yarn of the present embodiment may have a fineness of at least one selected from the group consisting of 30D/12F, 30D/24F, 30D/36F, 30D/48F, 45D/24F, 50D/24F, 50D/36F, 50D/72F, 50D/96F, and 75D/72F. Specifically, the polyester yarn may have a fineness of 50D/72F, but is not limited thereto. In particular, when the polyester yarn of the present embodiment has the above-described fineness, the fabric manufactured according to the present embodiment may have excellent elasticity, recovery, and color fastness to washing.

In the fabric forming step of the present embodiment, the latent crimped yarn and the polyester yarn may be knitted in a weight ratio of 1:0.5 to 2 to form the raw fabric. In particular, when forming the raw fabric by knitting the two yarns at the weight ratio of 1:0.5 to 2 in the fabric forming step of the present embodiment, the fabric obtained according to the present embodiment may realize excellent elasticity, recovery, and color fastness to washing, while having a significantly reduced defect rate occurring in the manufacturing process.

Specifically, in the fabric forming step of the present embodiment, the latent crimped yarn and the polyester yarn may be knitted in a weight ratio of 1:0.8 to 1.2 to form the raw fabric. In particular, when forming the raw fabric by knitting the two yarns at the weight ratio of 1:0.8 to 1.2 in the fabric forming step of the present embodiment, the fabric obtained according to the present embodiment may realize more excellent elasticity, recovery, and color fastness to washing, while having a significantly reduced defect rate occurring in the manufacturing process.

More specifically, in the fabric forming step of the present embodiment, the latent crimped yarn and the polyester yarn may be knitted in a weight ratio of 1:1.0 to 1.1 to form the raw fabric. In particular, when forming the raw fabric by knitting the two yarns at the weight ratio of 1:1.0 to 1.1 in the fabric forming step of the present embodiment, the fabric obtained according to the present embodiment may realize significantly excellent elasticity, recovery, and color fastness to washing, while having a significantly reduced defect rate occurring in the manufacturing process.

(b) The Fabric Reduction Step of Reducing the Raw Fabric

In the fabric reduction step of the present embodiment, the raw fabric obtained in the fabric forming step may be gradually reduced in stages. At this time, the reducing of the raw fabric may be performed by a known method of reducing fabric.

Specifically, in the fabric reduction step of the present embodiment, the raw fabric obtained in the fabric forming step may be reduced by being shrunk in the width direction.

More specifically, in the fabric reduction step of the present embodiment, the raw fabric obtained in the fabric forming step may be reduced by being shrunk in width by about 10 to 30%. For example, the fabric reduction step of the present embodiment may be performed by shrinking the raw fabric by 5 to 15% in the width direction, and then shrinking the shrunk raw fabric by 5 to 15% in the width direction. In particular, in the present embodiment, by performing the reducing of the raw fabric in stages, the defect rate occurring in the manufacturing process may be significantly reduced.

The fabric reduction step of the present embodiment may be performed at 60 to 80° C., specifically 65 to 75° C., and more specifically at 70° C. In particular, when the fabric reduction step of the present embodiment is performed at 60 to 80° C., the fabric manufactured according to the present embodiment has excellent elasticity, recovery, and color fastness to washing, while having a significantly reduced defect rate occurring in the manufacturing process.

(c) The Fabric Degreasing Step of Removing the Oil from the Raw Fabric

In the fabric degreasing step of the present embodiment, the raw fabric may be degreased by removing the oil from the raw fabric shrunk according to the above. At this time, the removing of the oil from the raw fabric may be performed by a known degreasing method.

Specifically, in the fabric degreasing step of the present embodiment, a degreasing composition may be treated on the raw fabric obtained according to the above, and the degreasing may be performed under a temperature condition of about 40 to 80° C. For example, in the fabric degreasing step of the present embodiment, the raw fabric may be treated with the degreasing composition by means of spraying or steam spraying under a temperature condition of about 40 to 80° C. At this time, the degreasing composition is not particularly limited in type as long as it is applicable to fabric.

(d) The Primary Tentering Step of Removing the Wrinkles of the Raw Fabric, Followed by Drying In the primary tentering step of the present embodiment, a tenter may be used to remove the wrinkles of the raw fabric degreased in the fabric degreasing step and, at the same time, to dry the raw fabric by applying heat thereto.

At this time, the removing of the wrinkles may be performed by a known method. In addition, the drying may be performed by a known drying method, e.g., by passing the raw fabric through a high-temperature chamber or by applying hot air to the raw fabric.

(e) The Fabric Dyeing Step of Dyeing the Raw Fabric

In the fabric dyeing step, the dyeing of the raw fabric may be performed by the dyeing step of dyeing the raw fabric with the disperse dye; the primary heat treatment step of subjecting the dyed raw fabric to the primary heat treatment at 35 to 45° C.; the secondary heat treatment step of subjecting the raw fabric subjected to the primary heat treatment to the secondary heat treatment at 75 to 85° C.; the tertiary heat treatment step of subjecting the raw fabric subjected to the secondary heat treatment to the tertiary heat treatment at 120 to 130° C.; and the fabric cooling step of cooling the raw fabric subjected to the tertiary heat treatment to 50 to 70° C.

In particular, in the present embodiment, after being dyed, as the raw fabric may be heat-treated in stages and then cooled, the elasticity, recovery, and color fastness to washing of the finally obtained fabric may be more excellent, and the defect rate occurring in the manufacturing process may be significantly reduced.

At this time, the dyeing and heat treating may be performed by any known method. For example, the fabric dyeing step of the present embodiment may be performed using the tenter, wherein the tenter may have at least six chambers for the three heat treatment steps and cooling, but is not limited thereto.

(e-1) the Dyeing Step of Dyeing the Raw Fabric with the Disperse Dye

In the dyeing step of dyeing the raw fabric with the disperse dye, the dyeing may be performed by impregnating the raw fabric with a dye solution containing the disperse dye or spraying the dye solution containing the disperse dye on the raw fabric.

For example, in the dyeing step of the present embodiment, the raw fabric may be dyed by placing a mixed dye solution in which the disperse dye, a dispersant, and a known solvent are mixed and the raw fabric into a dyeing machine, followed by stirring and removing a remainder of the dye solution. At this time, the pH of the mixed dye solution may be 4 to 5, but is not limited thereto.

(e-2) the Primary Heat Treatment Step of Subjecting the Dyed Raw Fabric to the Primary Heat Treatment at 35 to 45° C.

In the primary heat treatment step of the present embodiment, the dyed raw fabric may be subjected to the primary heat treatment at 35 to 45° C., specifically at 40° C. When the primary heat treatment step of the present embodiment is performed at a temperature less than 35° C. or a temperature exceeding 45° C., the elasticity, recovery, and dyeing properties of the finally obtained fabric may be deteriorated, and the defect rate may increase due to shrinkage or expansion due to heat.

In the primary heat treatment step of the present embodiment, the dyed raw fabric obtained in the dyeing step may be subjected to the primary heat treatment for 5 to 15 minutes at 35 to 45° C. When the primary heat treatment step of the present embodiment is performed at a temperature of 35 to 45° C., but is performed for a time less than about 5 minutes or a time exceeding 15 minutes, the elasticity, recovery, and dyeing properties of the finally obtained fabric may be deteriorated, and the defect rate may increase due to shrinkage or expansion due to heat.

(e-3) the Secondary Heat Treatment Step of Subjecting the Raw Fabric Subjected to the Primary Heat Treatment to the Secondary Heat Treatment at 75 to 85° C.

In the secondary heat treatment step of the present embodiment, the raw fabric subjected to the primary heat treatment in the primary heat treatment step may be subjected to the secondary heat treatment at 75 to 85° C., specifically at 80° C. When the secondary heat treatment step of the present embodiment is performed at a temperature less than 75° C. or a temperature exceeding 85° C., the elasticity, recovery, and dyeing properties of the finally obtained fabric may be deteriorated, and the defect rate may increase due to shrinkage or expansion due to heat.

In the secondary heat treatment step of the present embodiment, the raw fabric subjected to the primary heat treatment may be subjected to the secondary heat treatment at 75 to 85° C. for 2 to 8 minutes. When the secondary heat treatment step of the present embodiment is performed at a temperature of 75 to 85° C., but is performed for a time less than about 2 minutes or a time exceeding 8 minutes, the elasticity, recovery, and dyeing properties of the finally obtained fabric may be deteriorated, and the defect rate may increase due to shrinkage or expansion due to heat.

In the secondary heat treatment step of the present embodiment, the raw fabric subjected to the primary heat treatment at 35 to 45° C. in the primary heat treatment step may be subjected to heating to be secondarily heat-treated at 75 to 85° C., wherein the heating may be performed at a heating rate of 1.5° C./min. When the heating is performed to perform the secondary heat treatment after the primary heat treatment, when the heating rate is less than or exceeds 1.5° C./min, the elasticity, recovery, and dyeing properties of the finally obtained fabric may be deteriorated, and the defect rate may increase due to shrinkage or expansion due to heat.

(e-4) the Tertiary Heat Treatment Step of Subjecting the Raw Fabric Subjected to the Secondary Heat Treatment to the Tertiary Heat Treatment at 120 to 130° C.

In the tertiary heat treatment step of the present embodiment, the raw fabric subjected to the secondary heat treatment in the secondary heat treatment step may be subjected to the tertiary heat treatment at 120 to 130° C., specifically at 125° C. When the tertiary heat treatment step of the present embodiment is performed at a temperature less than 120° C. or a temperature exceeding 130° C., the elasticity, recovery, and dyeing properties of the finally obtained fabric may be deteriorated, and the defect rate may increase due to shrinkage or expansion due to heat.

In the tertiary heat treatment step of the present embodiment, the raw fabric subjected to the secondary heat treatment may be subjected to the tertiary heat treatment at 120 to 130° C. for 25 to 40 minutes. When the tertiary heat treatment step of the present embodiment is performed at a temperature of 120 to 130° C., but is performed for a time less than about 25 minutes or a time exceeding 40 minutes, the elasticity, recovery, and dyeing properties of the finally obtained fabric may be deteriorated, and the defect rate may increase due to shrinkage or expansion due to heat.

In the tertiary heat treatment step of the present embodiment, the raw fabric subjected to the secondary heat treatment at 75 to 85° C. in the secondary heat treatment step may be subjected to heating to be tertiarily heat-treated at 120 to 130° C., wherein the heating may be performed at a heating rate of 0.7° C./min. When the heating is performed to perform the tertiary heat treatment after the secondary heat treatment, when the heating rate is less than or exceeds 0.7° C./min, the elasticity, recovery, and dyeing properties of the finally obtained fabric may be deteriorated, and the defect rate may increase due to shrinkage or expansion due to heat.

According to the above, by sequentially performing the primary heat treatment step, the secondary heat treatment step, and the tertiary heat treatment step, the raw fabric may be sequentially shrunk, thereby preventing defects such as creases occurring during dyeing.

(e-5) The Cooling Step of Cooling the Raw Fabric Subjected to the Tertiary Heat Treatment to 50 to 70° C.

In the cooling step of the present embodiment, the raw fabric subjected to the tertiary heat treatment in the tertiary heat treatment step may be cooled to 50 to 70° C., specifically 60° C. When, in the cooling step of the present embodiment, the raw fabric subjected to the tertiary heat treatment is cooled to a temperature less than 50° C. or a temperature exceeding 70° C., the elasticity, recovery, and dyeing properties of the finally obtained fabric may be deteriorated, and the defect rate may increase due to shrinkage or expansion due to heat.

In the cooling step of the present embodiment, the raw fabric subjected to the tertiary heat treatment at 120 to 130° C. in the tertiary heat treatment step may be cooled to 50 to 70° C., wherein the cooling may be performed at a cooling rate of 1 to 3° C./min, specifically 2° C./min. At this time, the meaning that the cooling rate is 2° C./min may mean that the temperature decreases by 2° C. per minute.

When the cooling is performed after the tertiary heat treatment, when the cooling rate is less than 1° C./min or exceeds 3° C./min, the elasticity, recovery, and dyeing properties of the finally obtained fabric may be deteriorated, and the defect rate may increase due to shrinkage or expansion due to heat.

(f) The Secondary Tentering Step of Removing the Wrinkles of the Raw Fabric, Followed by Drying to Form the Highly Elastic Fabric In the secondary tentering step of the present embodiment, the tenter may be used to remove the wrinkles of the raw fabric dyed in the fabric dyeing step and, at the same time, to dry the raw fabric by applying heat thereto, thereby forming the highly elastic fabric.

In particular, by finally drying the raw fabric by applying heat thereto, the structure of the fabric may be fixed, thereby controlling shrinkage and elongation of the fabric to an appropriate level. At this time, the meaning that the shrinkage and elongation of the fabric are controlled to the appropriate level may mean that the shrinkage and elongation occur within about 3%, but is not limited thereto.

The removing of the wrinkles may be performed by a known method. In addition, the drying may be performed by a known drying method, e.g., by passing the raw fabric through a high-temperature chamber or by applying hot air to the raw fabric.

The fabric manufactured according to the above may be further subjected to processing, such as cutting, forming additional patterns, forming creases, and forming wrinkles.

Hereinafter, a method of manufacturing a highly elastic fabric including a latent crimped yarn according to the present disclosure will be described in detail through Examples, Comparative Examples, and Experimental Examples. Since these Examples are for illustrative purposes only, the scope of the present disclosure is not to be construed as being limited by these Examples.

EXAMPLE

Example 1

(a) A latent crimped yarn (Fineness: 50D/36F) and a polyester yarn (fineness: 50D/72F) were knitted by being mixed in a weight ratio of 1:0.1 to prepare a raw fabric.

As the latent crimped yarn, a bi-component yarn, which was obtained by conjugate-spinning polytrimethylene terephthalate (PTT) and polyethylene terephthalate (PET) on a yarn cross-section in a side-by-side form, was used. In addition, the latent crimp yarn had a crimp potential and boiling water shrinkage as illustrated in Table 1.

TABLE 1

| | Latent crimped yarn of Example 1 |
|---|---|
| Crimp potential (%) | 74 |
| Boiling water shrinkage (%) | 18.4 |

In Table 1, the crimp potential was evaluated according to DIN 53840, and the boiling water shrinkage was evaluated according to DIN 53866.

(b) The raw fabric prepared according to the above was reduced by being shrunk by about 23% in the width direction (width length: 105 cm→80 cm) under a temperature condition of about 70° C.

(c) Thereafter, the raw fabric was degreased by being treated with a degreasing composition containing water by means of spraying to remove oil from the raw fabric. At this time, the degreasing was performed at a temperature condition of about 40 to 80° C.

(d) Subsequently, wrinkles of the raw fabric degreased according to the above were removed using a tenter. In addition, the raw fabric was dried by performing the above process at a temperature condition of about 150 to 180° C.

(e) The dried raw fabric was dyed according to the following procedure.

Specifically, (e-1) the raw fabric was dyed by placing the raw fabric and a mixed dye solution containing a disperse dye into a dyeing machine, followed by mixing, then, (e-2) the dyed raw fabric was subjected to a primary heat treatment at 40° C. for 10 minutes, followed by heating at a heating rate of about 1.5° C./min, and then, (e-3) the raw fabric subjected to the primary heat treatment was subjected to a secondary heat treatment at 80° C. for 5 minutes. At this time, as the disperse dye contained in the mixed dye solution, C.I. Disperse Red 362 was used.

Thereafter, the raw fabric subjected to the secondary heat treatment was heated at a heating rate of 0.7° C./min so that (e-4) the raw fabric subjected to the secondary heat treatment was subjected to a tertiary heat treatment at 125° C. for about 30 minutes, and then, (e-5) the raw fabric was cooled to 60° C. at a cooling rate of about 2° C./min.

(f) Finally, wrinkles of the dyed raw fabric were removed using the tenter. In addition, the raw fabric was dried by performing the above process at a temperature condition of about 150 to 180° C., thereby preparing a highly elastic fabric.

Examples 2 to 3

The same procedure was performed as in Example 1, except that in (a) the fabric forming step, a latent crimped yarn and a polyester yarn were knitted by being mixed at a weight ratio illustrated in Table 2 [unit: weight ratio].

TABLE 2

| | Example 1 | Example 2 | Example 3 |
|---|---|---|---|
| Latent crimped yarn | 1 | 1 | 1 |
| Polyester yarn | 0.1 | 1.08 | 2.5 |

COMPARATIVE EXAMPLE

Comparative Examples 1 to 4

The same procedure was performed as in Example 3, except that a latent crimped yarn and a polyester yarn having the fineness illustrated in Table 3 were used.

TABLE 3

| | Comparative Example 1 | Comparative Example 2 | Comparative Example 3 | Comparative Example 4 |
|---|---|---|---|---|
| Latent crimped yarn | 40D/36F | 60D/36F | 50D/36F | 50D/36F |
| Polyester yarn | 50D/72F | 50D/72F | 40D/72F | 60D/72F |

Comparative Examples 5 to 8

The same procedure was performed as in Example 3, except that a primary heat treatment was performed under the conditions illustrated in Table 4.

TABLE 4

| | Comparative Example 5 | Comparative Example 6 | Comparative Example 7 | Comparative Example 8 |
|---|---|---|---|---|
| Primary heat treatment temperature (° C.) | 25 | 55 | 40 | 40 |
| Primary heat treatment time (min) | 10 | 10 | 1 | 20 |

Comparative Examples 9 to 12

The same procedure was performed as in Example 3, except that a secondary heat treatment was performed under the conditions illustrated in Table 5.

TABLE 5

| | Comparative Example 9 | Comparative Example 10 | Comparative Example 11 | Comparative Example 12 |
|---|---|---|---|---|
| Secondary heat treatment temperature (° C.) | 65 | 95 | 80 | 80 |
| Secondary heat treatment time (min) | 5 | 5 | 0.5 | 13 |

Comparative Examples 13 to 16

The same procedure was performed as in Example 3, except that a tertiary heat treatment was performed under the conditions illustrated in Table 6.

TABLE 6

| | Comparative Example 13 | Comparative Example 14 | Comparative Example 15 | Comparative Example 16 |
|---|---|---|---|---|
| Tertiary heat treatment temperature (° C.) | 110 | 140 | 125 | 125 |
| Tertiary heat treatment time (min) | 30 | 30 | 20 | 45 |

Comparative Examples 17 to 18

The same procedure was performed as in Example 3, except that cooling was performed under the conditions illustrated in Table 7 [unit: ° C./min].

TABLE 7

| | Comparative Example 17 | Comparative Example 18 |
|---|---|---|
| Cooling rate | 0.5° C./min | 4° C./min |

Comparative Example 19

The same procedure was performed as in Example 3, except that a latent crimp yarn having a fineness of 50D/72F, a crimp potential of 25.7%, and a boiling water shrinkage of 5.1% was used.

Comparative Example 20

The same procedure was performed as in Example 3, except that a latent crimp yarn having a fineness of 50D/72F, a crimp potential of 81.6%, and a boiling water shrinkage of 3.6% was used.

EXPERIMENTAL EXAMPLE

Experimental Example 1: Evaluation of Elasticity (Elongation and Recovery)

Examples 1 to 3 and Comparative Examples 1 to 20 were evaluated for elongation and recovery, and the results are illustrated in Tables 8 to 9 [unit: %].

The elongation (%) and recovery (%) were evaluated according to ASTM D 4964: 1996 (Mod.), and the result values of 'Load (Ibs) at 60% Elongation' were described for the elongation.

In addition, for comparison, elongation and recovery of spandex were measured and described in Tables 8 to 9.

TABLE 8

| | Wale | Course |
|---|---|---|
| Example 1 | 5.19 | 1.09 |
| Example 2 | 7.92 | 1.58 |
| Example 3 | 5.84 | 1.14 |
| Comparative Example 1 | 2.54 | 0.84 |
| Comparative Example 2 | 2.36 | 0.80 |
| Comparative Example 3 | 2.94 | 0.79 |
| Comparative Example 4 | 2.85 | 0.82 |
| Comparative Example 5 | 1.64 | 0.43 |
| Comparative Example 6 | 1.78 | 0.50 |
| Comparative Example 7 | 1.94 | 0.37 |
| Comparative Example 8 | 1.54 | 0.41 |
| Comparative Example 9 | 1.91 | 0.57 |
| Comparative Example 10 | 1.40 | 0.44 |
| Comparative Example 11 | 1.19 | 0.39 |
| Comparative Example 12 | 1.25 | 0.29 |
| Comparative Example 13 | 1.36 | 0.58 |
| Comparative Example 14 | 1.74 | 0.60 |
| Comparative Example 15 | 1.99 | 0.54 |
| Comparative Example 16 | 1.54 | 0.41 |
| Comparative Example 17 | 1.06 | 0.50 |
| Comparative Example 18 | 0.54 | 0.20 |
| Comparative Example 19 | 1.76 | 0.64 |
| Comparative Example 20 | 1.60 | 0.57 |
| Spandex | 9.34 | 2.01 |

TABLE 9

| | Recovery (%) |
|---|---|
| Example 1 | 86.6 |
| Example 2 | 91.8 |
| Example 3 | 87.4 |
| Comparative Example 1 | 73.2 |
| Comparative Example 2 | 76.0 |
| Comparative Example 3 | 71.8 |
| Comparative Example 4 | 75.0 |
| Comparative Example 5 | 63.0 |
| Comparative Example 6 | 62.5 |
| Comparative Example 7 | 60.8 |
| Comparative Example 8 | 67.7 |

TABLE 9-continued

| | Recovery (%) |
|---|---|
| Comparative Example 9 | 63.1 |
| Comparative Example 10 | 62.9 |
| Comparative Example 11 | 64.3 |
| Comparative Example 12 | 63.4 |
| Comparative Example 13 | 65.0 |
| Comparative Example 14 | 66.6 |
| Comparative Example 15 | 61.8 |
| Comparative Example 16 | 69.9 |
| Comparative Example 17 | 58.4 |
| Comparative Example 18 | 50.1 |
| Comparative Example 19 | 65.9 |
| Comparative Example 20 | 61.8 |
| Spandex | 95.9 |

Referring to Table 8, it can be seen that when following the present embodiment, the elongation is excellent in both the vertical direction and the horizontal direction. In addition, referring to Table 9, it can be seen that when following the present embodiment, the recovery is excellent.

In particular, it can be seen that, according to the present embodiment, by the use of the latent crimped yarn of bi-component type obtained by conjugate-spinning PTT and PET on the yarn cross-section in a side-by-side form and having a crimp potential of 20 to 80% and a boiling water shrinkage of 10 to 50%, both the elongation and recovery of the fabric are excellent.

That is, based on the above, it can be seen that the fabric manufactured according to the present embodiment has excellent elasticity.

Experimental Example 2: Evaluation of Presence/Absence of Creases

After visually observing the state of fabrics prepared according to Examples 1 to 3 and Comparative Examples 1 to 20, presence/absence of defects is illustrated in Table 10. At this time, when creases, which are "wrinkles appearing on the surface of fabric", occurred, this was evaluated as defective (○), and when the creases did not occur, this was evaluated as non-defective (X).

Figure 2:
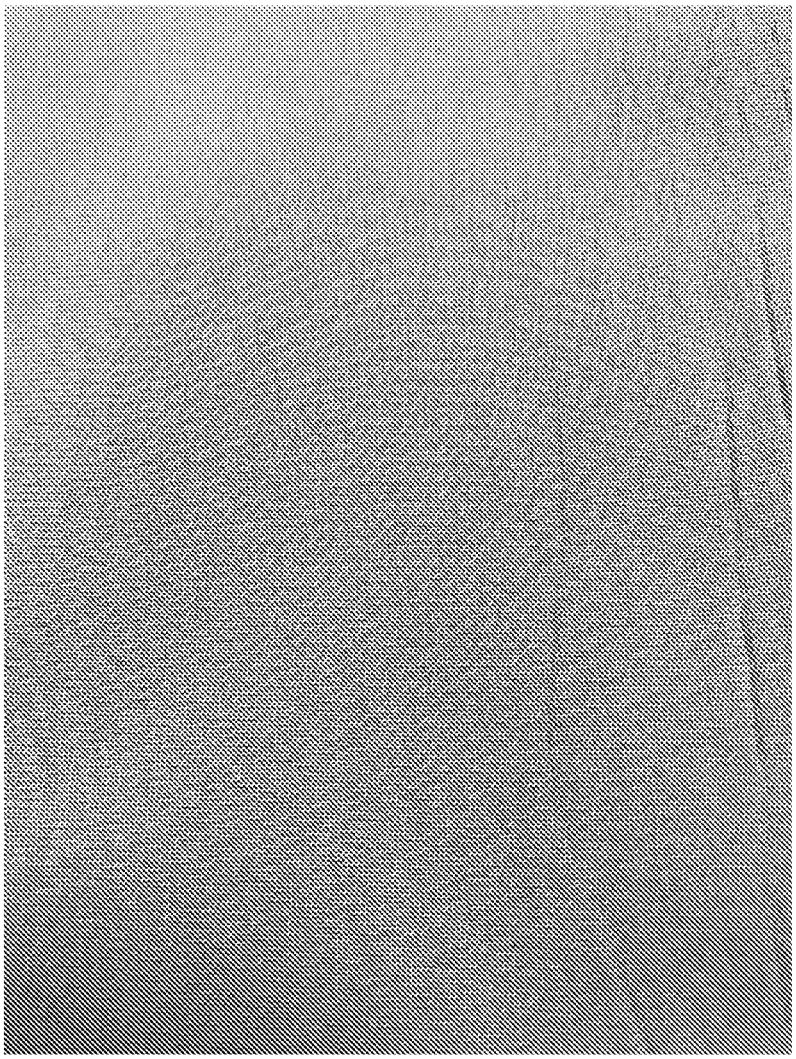
FIG. 2 is a view illustrating a fabric manufactured according to Comparative Example 20.

In addition, the fabric according to Example 1 is illustrated in FIG. 1, the fabric according to Comparative Example 20 is illustrated in FIG. 2.

TABLE 10

| | Presence/absence of defects |
|---|---|
| Example 1 | X |
| Example 2 | X |
| Example 3 | X |
| Comparative Example 1 | ○ |
| Comparative Example 2 | ○ |
| Comparative Example 3 | ○ |
| Comparative Example 4 | ○ |
| Comparative Example 5 | ○ |
| Comparative Example 6 | ○ |
| Comparative Example 7 | ○ |
| Comparative Example 8 | ○ |
| Comparative Example 9 | ○ |
| Comparative Example 10 | ○ |
| Comparative Example 11 | ○ |
| Comparative Example 12 | ○ |
| Comparative Example 13 | ○ |
| Comparative Example 14 | ○ |
| Comparative Example 15 | ○ |
| Comparative Example 16 | ○ |
| Comparative Example 17 | ○ |
| Comparative Example 18 | ○ |

TABLE 10-continued

| | Presence/absence of defects |
|---|---|
| Comparative Example 19 | ○ |
| Comparative Example 20 | ○ |

Referring to Table 10, it can be seen that when following the present embodiment, no defects occur.

In addition, referring to FIGS. 1 and 2, it was confirmed that while creases do not occur in the fabric when following the present embodiment, creases occur in the fabric when not following the present embodiment.

Experimental Example 3: Evaluation of Color Fastness to Washing

Color fastness to washing of fabrics of Examples and Comparative Examples was measured, and the results are illustrated in Table 11. At this time, the color fastness to washing was evaluated according to KSK 0430 A-1.

TABLE 11

| | Color fastness to washing |
|---|---|
| Example 1 | 5 |
| Example 2 | 5 |
| Example 3 | 5 |
| Comparative Example 1 | 4 |
| Comparative Example 2 | 4 |
| Comparative Example 3 | 4 |
| Comparative Example 4 | 4 |
| Comparative Example 5 | 3 |
| Comparative Example 6 | 3 |
| Comparative Example 7 | 3 |
| Comparative Example 8 | 3 |
| Comparative Example 9 | 3 |
| Comparative Example 10 | 3 |
| Comparative Example 11 | 3 |
| Comparative Example 12 | 3 |
| Comparative Example 13 | 3 |
| Comparative Example 14 | 3 |
| Comparative Example 15 | 3 |
| Comparative Example 16 | 3 |
| Comparative Example 17 | 3 |
| Comparative Example 18 | 3 |
| Comparative Example 19 | 4 |
| Comparative Example 20 | 4 |

Referring to Table 11, it can be seen that when following the present embodiment, the color fastness to washing is excellent.

Summarizing the contents of Experimental Examples 1 to 3, according to the present embodiment, it can be seen that it is possible to realize elasticity similar to or superior than spandex without requiring the use of spandex, as well as to minimize defects such as creases occurring during manufacturing, and to ensure excellent color fastness to washing.

The foregoing description of the present disclosure is for illustrative purposes only and not for the purpose of limiting the disclosure. Those skilled in the art will appreciate that various modifications, additions, and substitutions are possible, without changing the spirit or essential features of the present disclosure. Therefore, the embodiments described above are to be considered illustrative in all respects and are not intended to limit the disclosure. For example, each component referred to as a single type may be divided, and components referred to as being divided may be combined as a single type.

The scope of the present disclosure is defined by the following claims rather than the foregoing description. Moreover, the present disclosure is intended to cover not only the exemplary embodiments, but also various alternatives, modifications, equivalents, and other embodiments that may be included within the spirit and scope of the present disclosure as defined by the accompanying claims.

What is claimed is:

1. A method of manufacturing an elastic fabric including a latent crimped yarn, the method comprising:

forming a raw fabric by knitting the latent crimped yarn and a polyester yarn;

reducing the raw fabric;

removing oil from the raw fabric;

removing wrinkles of the raw fabric, followed by drying;

dyeing the raw fabric; and removing wrinkles of the raw fabric, followed by drying to form the elastic fabric, wherein the dyeing of the raw fabric comprises:

dyeing the raw fabric with a disperse dye;

subjecting the dyed raw fabric to a primary heat treatment at 35 to 45° C.;

subjecting the raw fabric subjected to the primary heat treatment to a secondary heat treatment at 75 to 85° C.;

subjecting the raw fabric subjected to the secondary heat treatment to a tertiary heat treatment at 120 to 130° C.; and cooling the raw fabric subjected to the tertiary heat treatment to 50 to 70° C.

2. The method of claim 1, wherein the latent crimped yarn is a yarn obtained by conjugate-spinning polytrimethylene terephthalate (PTT) and polyethylene terephthalate (PET) on a yarn cross-section in a side-by-side form.

3. The method of claim 1, wherein the latent crimped yarn has a crimp potential of 20 to 80%.

4. The method of claim 1, wherein the latent crimped yarn has a boiling water shrinkage of 10 to 50%.

5. The method of claim 1, wherein the latent crimped yarn has a fineness of at least one selected from the group consisting of 30D/24F, 30D/36F, 50D/24F, 50D/36F, 75D/24F, 75D/32F, and 75D/36F.

6. The method of claim 1, wherein the polyester yarn has a fineness of at least one selected from the group consisting of 30D/12F, 30D/24F, 30D/36F, 30D/48F, 45D/24F, 50D/24F, 50D/36F, 50D/72F, 50D/96F, and 75D/72F.

7. The method of claim 1, wherein the forming of the raw fabric is performed by knitting the latent crimped yarn and the polyester yarn in a weight ratio of 1:0.5 to 2 to form the raw fabric.

8. The method of claim 1, wherein the primary heat treatment is performed for 5 to 15 minutes.

9. The method of claim 1, wherein the secondary heat treatment is performed for 2 to 8 minutes.

10. The method of claim 1, wherein the tertiary heat treatment is performed for 25 to 40 minutes.

11. The method of claim 1, wherein the cooling of the raw fabric is performed by cooling the raw fabric subjected to the tertiary heat treatment at a cooling rate of 1 to 3° C./min.

* * * * *